US005276979A

United States Patent [19]

Gordon, Sr.

[11] Patent Number: 5,276,979

[45] Date of Patent: Jan. 11, 1994

[54] SHOE DRYING SUPPORT APPARATUS

[76] Inventor: Martin C. Gordon, Sr., 2724 Regester Farm Rd., Forest Hill, Md. 21050

[21] Appl. No.: 12,767

[22] Filed: Feb. 3, 1993

[51] Int. Cl.[5] ..... F26B 11/02

[52] U.S. Cl. ..... 34/133 E; 34/109; 34/60; 34/133 B; 68/143

[58] Field of Search ..... 34/133 R, 133 E, 133 D, 133 G, 133 J, 109, 237, 238, 239, 240; 68/143, 144; 34/60, 133 B

[56] References Cited

U.S. PATENT DOCUMENTS

| | | | |
|---|---|---|---|
| 2,298,352 | 10/1942 | Downes | 34/109 |
| 3,316,659 | 5/1967 | Lauck | 34/133 F |
| 3,344,532 | 10/1967 | Bigler | 34/133 E |
| 3,724,095 | 4/1973 | Laue et al. | 34/133 E |
| 4,091,548 | 5/1978 | Daily | 34/133 E |
| 4,109,397 | 8/1978 | Daily | 34/133 E |
| 4,467,535 | 8/1984 | Hardison | 34/133 E |
| 4,617,743 | 10/1986 | Barnard | 34/133 E |
| 4,908,959 | 3/1990 | Kretchman et al. | 34/133 E |

*Primary Examiner*—Henry A. Bennet
*Assistant Examiner*—Denise Gromada
*Attorney, Agent, or Firm*—Leon Gilden

[57] ABSTRACT

A mesh tubular basket is arranged for mounting about a support tube and secured at each end of the mesh basket by strap members to position canvas type shoes and the like within a clothes dryer during a drying procedure. The support tube is arranged with a spring-biased sleeve, having a collar member to secure the sleeve if desired in a biased orientation against an interior wall of a drying machine drum.

3 Claims, 4 Drawing Sheets

SHOE DRYING SUPPORT APPARATUS

BACKGROUND OF THE INVENTION

1. Field of the Invention

The field of invention relates to show drying apparatus, and more particularly pertains to a new and improved shoe drying support apparatus wherein the same is directed to the positioning of tennis shoes and the like within a clothes dryer.

2. Description of the Prior Art

Structure for positioning shoes and the like within a dryer is addressed in U.S. Pat. No. 4,702,016, wherein the use of a magnetic plate is arranged to secure shoes to be dried in adjacency to a shoe drying drum, wherein the shoe is fixedly positioned relative to the interior surface of the drum.

U.S. Pat. No. 3,840,998 to Marcussen sets forth a basket for positioning within a dryer structure.

U.S. Pat. Nos. 4,908,957 and 5,016,364 are examples of structure arranged to effect drying of shoes and the like.

The instant invention attempts to overcome deficiencies of the prior art by providing the shoes to be tumbled within a clothes drum when positioned within a securing basket and in this respect, the present invention substantially fulfills this need.

SUMMARY OF THE INVENTION

In view of the foregoing disadvantages inherent in the known types of shoe drying apparatus now present in the prior art, the present invention provides a shoe drying support apparatus wherein the same is arranged to secure fabric shoes within a clothes dryer to effect their drying and tumbling within the clothes dryer drum. As such, the general purpose of the present invention, which will be described subsequently in greater detail, is to provide a new and improved shoe drying support apparatus which has all the advantages of the prior art shoe drying apparatus and none of the disadvantages.

To attain this, the present invention provides a mesh tubular basket arranged for mounting about a support tube and secured at each end of the mesh basket by strap members to position canvas type shoes and the like within a clothes dryer during a drying procedure. The support tube is arranged with a spring-biased sleeve, having a collar member to secure the sleeve if desired in a biased orientation against an interior wall of a drying machine drum.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe drying support apparatus which has all the advantages of the prior art shoe drying apparatus and none of the disadvantages.

It is another object of the present invention to provide a new and improved shoe drying support apparatus which may be easily and efficiently manufactured and marketed.

It is a further object of the present invention to provide a new and improved shoe drying support apparatus which is of a durable and reliable construction.

An even further object of the present invention is to provide a new and improved shoe drying support apparatus which is susceptible of a low cost of manufacture with regard to both materials and labor, and which accordingly is then susceptible of low prices of sale to the consuming public, thereby making such shoe drying support apparatus economically available to the buying public.

Still yet another object of the present invention is to provide a new and improved shoe drying support apparatus which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
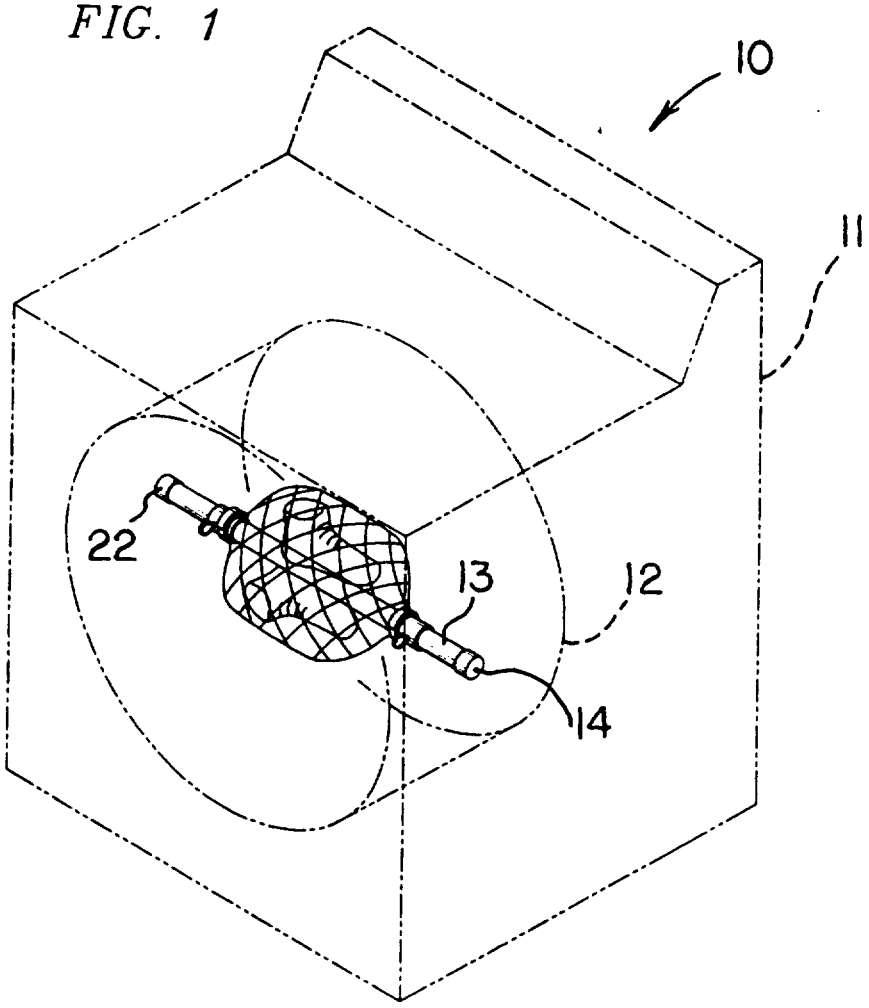
FIG. 1 is an isometric illustration of the invention in use.
Figure 2:
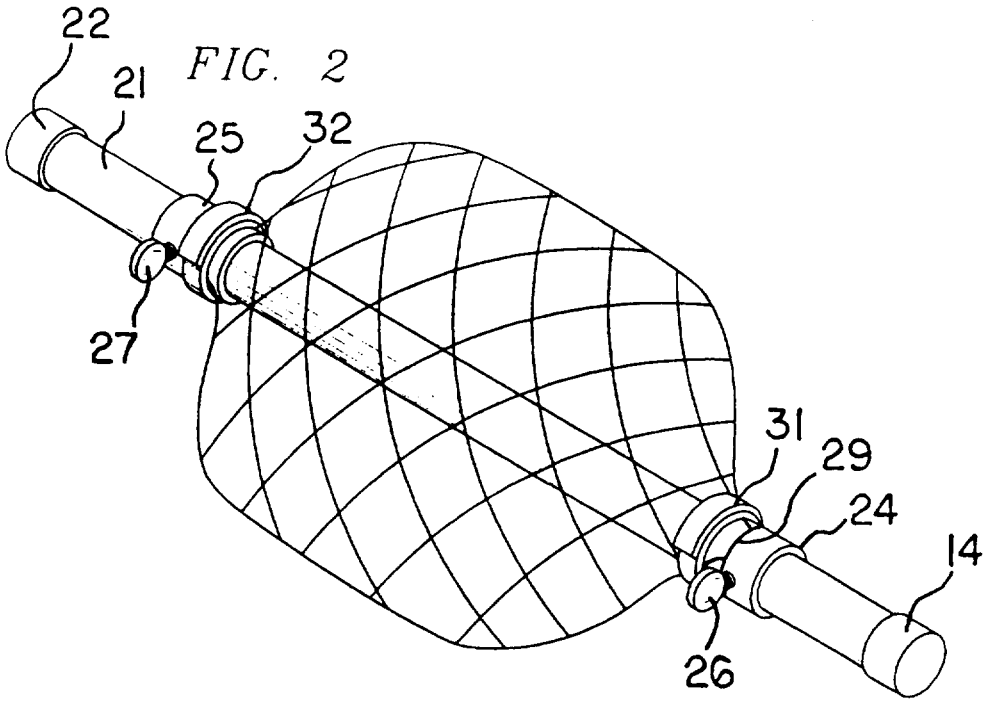
FIG. 2 is an enlarged isometric illustration of the invention.
Figure 3:
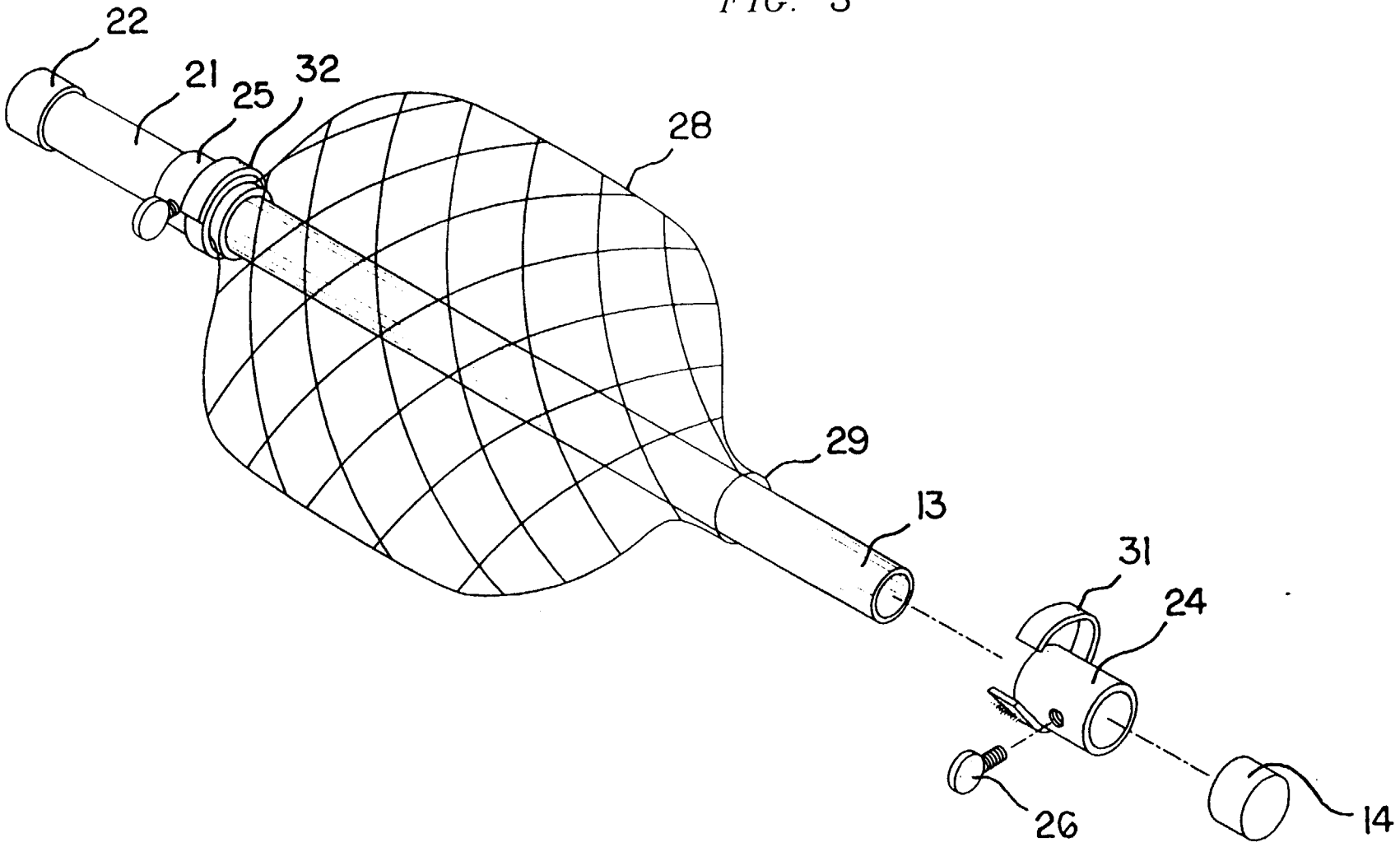
FIG. 3 is an isometric illustration of the invention in a partially exploded view.
Figure 4:
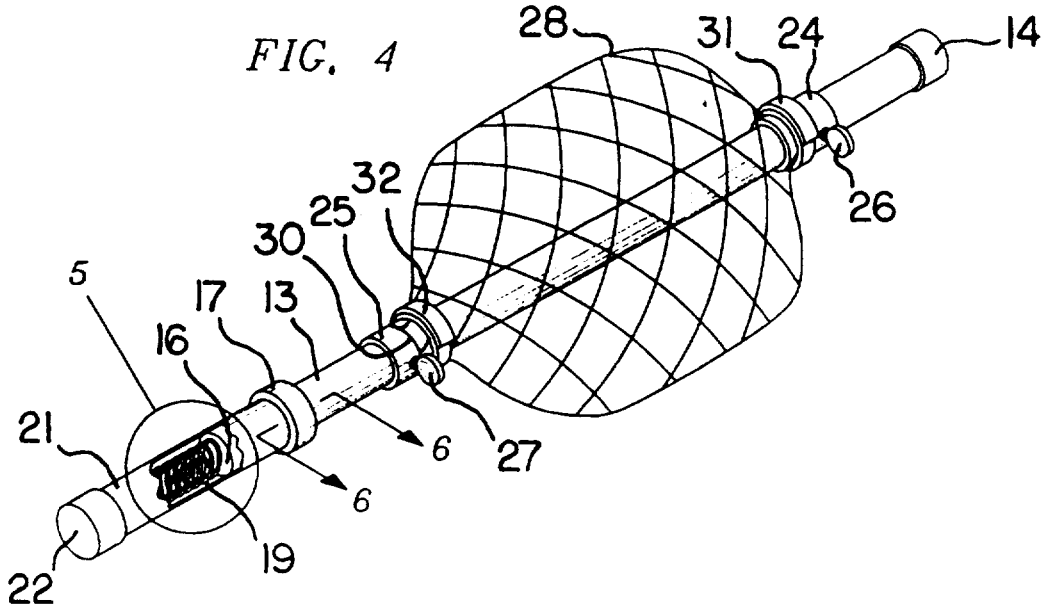
FIG. 4 is an isometric view, partially in section, indicating the spring-biased construction of the outer sleeve.
Figure 5:
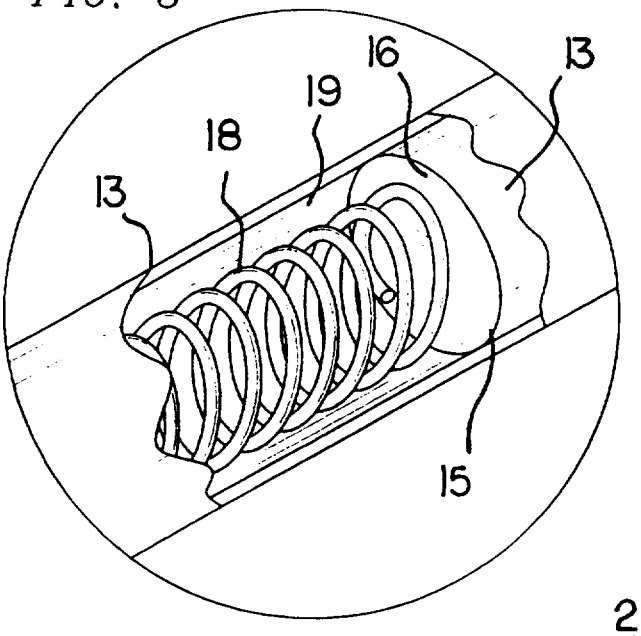
FIG. 5 is an enlarged isometric illustration of section 5 as set forth in FIG. 4.
Figure 6:
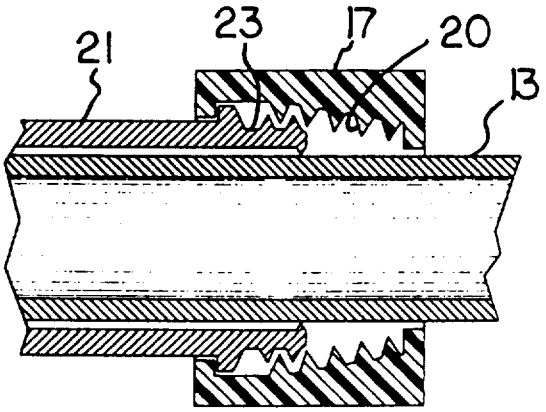
FIG. 6 is an orthographic view, taken along the lines 6—6 of FIG. 4 in the direction indicated by the arrows.

With reference now to the drawings, and in particular to FIGS. 1 to 8 thereof, a new and improved shoe drying support apparatus embodying the principles and concepts of the present invention and generally designated by the reference numeral 10 will be described.

More specifically, the shoe drying support apparatus 10 of the instant invention essentially comprises the invention arranged for positioning within a clothes dryer 11, and more specifically, within a clothes dryer drum 12. To this end, a mounting tube 15 is provided, having a first end, including a first end resilient cap 14 mounted thereon for frictional engagement within the drum 12. The mounting tube includes a mounting tube second end terminating in a mounting tube abutment wall 16 (see FIGS. 4 and 5). The abutment wall 16 is spaced from a locking collar 17, with the locking collar including a collar conical internally threaded surface 20 arranged for threaded engagement and securing of an outer sleeve 21, and more specifically, the outer sleeve first end having a sleeve externally threaded cylindrical first end surface 23. In this manner, the conical threads are arranged to lock the sleeve in a predetermined orientation along the mounting tube 13 (see FIG. 6). The outer sleeve 21 accordingly includes an outer sleeve cavity 19 oriented between the abutment wall 16 and an outer sleeve resilient cap 22 positioned at a second end of the outer sleeve 21, with a biasing spring 18 positioned within the cavity 19 to effect biasing of the outer sleeve 21 exteriorly of the abutment wall in a projecting manner to effect engagement within the clothes dryer drum 12. In this manner, the locking sleeve 17 need not be employed as the spring-biased engagement of the outer sleeve resilient cap 22, as well as the engagement of the mounting tube first end resilient 14, may position the structure within the drum 12. If additional tension is desired, the locking collar 17 and the outer sleeve first end are slid along the mounting tube 13 to provide for enhanced pressure engagement of the mounting tube 13 within the drum 12.

First and second lock sleeve 24 and 25 are mounted to the mounting tube 13 in a spaced relationship between the locking collar 17 and the mounting tube first end. Securing the locking sleeves are respective first and second fasteners 26 and 27 directed through the locking sleeves for engagement with the mounting tube 13 for fixed positioning of the respective first and second lock sleeves 24 and 25. A tubular net 28 is directed between the first and second lock sleeves 24 and 25, wherein the tubular end includes a tubular net first end 29 arranged for positioning over the sleeve 24, with a first securement strap 31 positioned over the net first end 29 and the lock sleeve 24. The tubular net includes a tubular net second end 30 positioned over the second sleeve 25 utilizing a second securement strap 32 securing the net second end about the second sleeve 25. The first and second securement straps 31 and 32 are secured to respective first and second hook and loop fastener ends for ease of securement of the straps about the respective first and second sleeves 24 and 25. Alternative fastening of the straps may be employed such as snap fasteners, resilient straps, and the like. In this manner, once the net first and second ends 29 and 30 are mounted to respective first and second sleeves 24 and 25, the sleeves may be extended in a spacing away from one another or towards one another to provide for volumetric reshaping of the net structure dependent upon the type of shoes and the nature of other garments within the associated clothes dryer drum 12.

Figure 7:
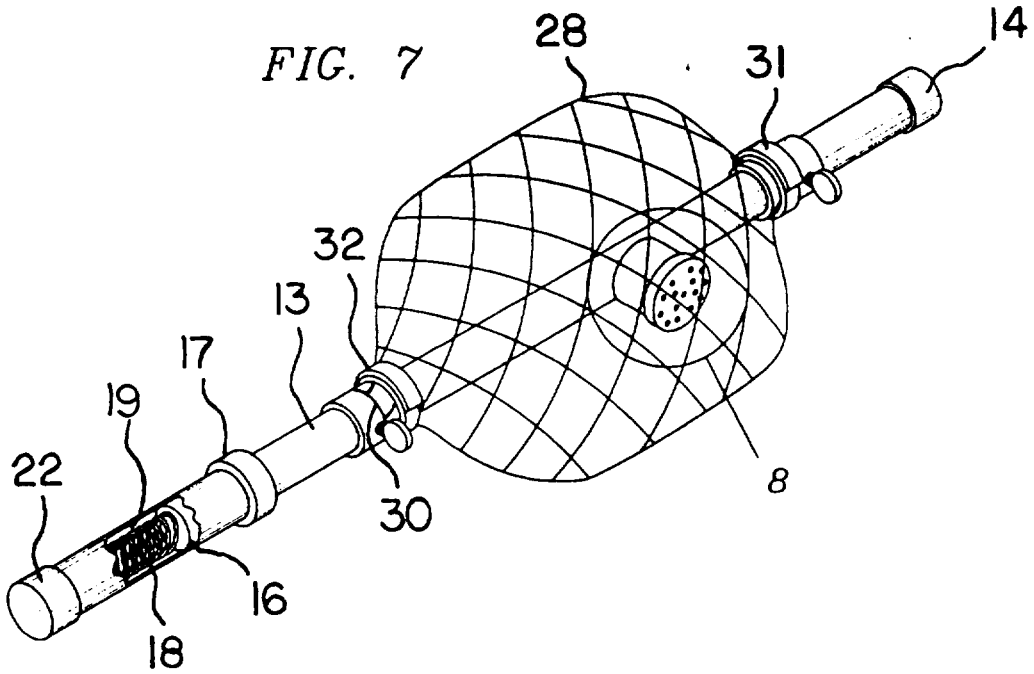
FIG. 7 is an isometric illustration of the invention employing a deodorizing dispenser structure.
Figure 8:
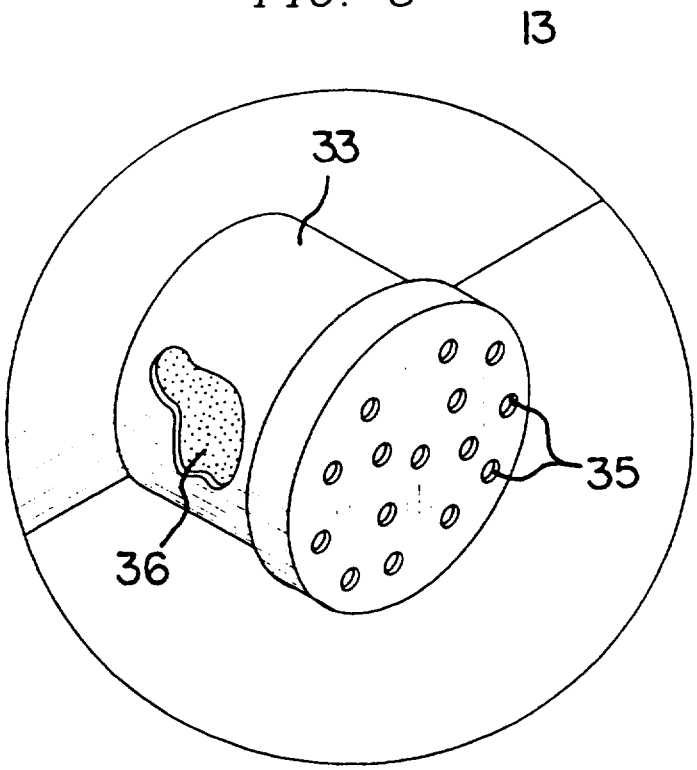
FIG. 8 is an enlarged orthographic view of section 8 as set forth in FIG. 7.

The FIGS. 7 and 8 indicate the use of a container housing 33 mounted to the mounting tube 13 within the tubular net 28. The container housing 33 includes a cap 34 removably mounted relative to the container housing 33 employing threaded engagement and the like. A matrix of cap apertures 35 are directed through the cap 34 to provide for the selective metering and dispensing of a deodorizing powder 36 from within the container housing 33 that is dispensed during the tumbling and rotation of the clothes dryer drum 12 to provide for enhanced freshness and deodorizing of the shoes within the clothes dryer drum.

It is understood that the shoes to be dried, such as indicated in FIG. 1, are initially positioned within the net structure prior to its securement relative to the associated sleeves 24 and 25, wherein in this manner, associated socks and the like that are to be separated relative to other clothes within the drum structure may be also positioned within the net during a drying procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe drying support apparatus arranged for positioning within a clothes dryer drum, wherein the apparatus comprises, a mounting tube, the mounting tube having a first end, including a first end resilient cap mounted to the first end, and a mounting tube second end, wherein the mounting tube second end includes an outer sleeve extending from the second end, the outer sleeve including a first end extending over the mounting tube from the mounting tube first end, and the outer tube including an outer sleeve second end having an outer sleeve resilient cap mounted to the outer sleeve second end, wherein the outer sleeve resilient cap and the mounting tube first end resilient cap are arranged for frictional engagement within the clothes dryer drum, and a tubular net arranged for securement about the mounting tube between the mounting tube first end and the mounting tube second end, with the tubular net arranged for receiving shoes for drying within the clothes dryer drum, and the mounting tube second end includes an abutment wall, and the outer sleeve includes an outer sleeve cavity extending between the abutment wall and the outer sleeve second end, and a spring member positioned within the cavity captured between the abutment wall and the outer sleeve resilient cap biasing the outer sleeve in an extended orientation relative to the abutment wall, and the outer sleeve first end includes a cylindrical externally threaded first end surface, and further including a locking collar, the locking collar including a locking collar conical threaded interior surface, with the conical interior surface arranged for threaded engagement with the sleeve externally threaded first end surface to permit locking of the outer sleeve first end relative to the mounting tube.

2. An apparatus as set forth in claim 1 including a first lock sleeve positioned about the mounting tube adjacent the mounting tube first end, and a second lock sleeve positioned about the mounting tube adjacent the mounting tube second end, with the lock sleeve including a first lock sleeve fastener, the second lock sleeve including a second lock sleeve fastener to selectively secure the first lock sleeve and the second lock sleeve relative to the mounting tube, with the tubular net including a tubular net first end positioned about the first lock sleeve, the tubular net having a tubular net second end positioned about the second lock sleeve, and a first securement strap directed about the tubular net first end, and a second securement strap secured about the tubular net second end, wherein the first securement strap is positioned about the first lock sleeve and the second securement strap is secured about the second lock sleeve.

3. An apparatus as set forth in claim 2 including a container housing fixedly secured to the mounting tube within the tubular net, the container housing including a cap, the cap including a plurality of cap apertures directed through the cap, and a deodorizing powder container within the container housing for dispensing through the apertures during a drying procedure within the clothes dryer drum.

* * * * *